United States Patent [19]

Westerkamp et al.

[11] 4,414,898

[45] Nov. 15, 1983

[54] MOUNTING FOR PRINTING CYLINDERS OR THE LIKE WITH ADJUSTABLE SIDE REGISTER

[75] Inventors: Jürgen Westerkamp, Westphalia; Bruno Marquardt, Georgsmarienhütte, both of Fed. Rep. of Germany

[73] Assignee: Windmoller & Holscher, Lengerich, Fed. Rep. of Germany

[21] Appl. No.: 395,317

[22] Filed: Jul. 6, 1982

[30] Foreign Application Priority Data

Jul. 6, 1981 [DE] Fed. Rep. of Germany ..... 3126561

[51] Int. Cl.[3] ..... B41F 13/24

[52] U.S. Cl. ..... 101/248

[58] Field of Search ..... 101/248, 348, 349

[56] References Cited

U.S. PATENT DOCUMENTS

| | | | |
|---|---|---|---|
| 1,737,378 | 11/1929 | Littel | 101/248 X |
| 2,986,997 | 6/1961 | Schmutz | 101/248 |
| 4,214,528 | 7/1980 | Mirow | 101/248 |

*Primary Examiner*—E. H. Eickholt

*Attorney, Agent, or Firm*—Fleit, Jacobson, Cohn & Price

[57] ABSTRACT

In a printing cylinder with an adjustable side register and having internally conical ends by which the cylinder is clamped in position between external cones, the external cones are on the confronting ends of journals. One of the journals is axially immovable in a first sleeve which is axially displaceable but non-rotatable. The first sleeve is screw-connected to an axially immovable second sleeve provided with a rotary drive for adjusting the cylinder axially. The journals can be stressed towards each other by the piston rods of hydraulic piston-cylinder units of which the cylinders can be interconnected and have oppositely varying volumes when the side register is being adjusted.

9 Claims, 4 Drawing Figures

MOUNTING FOR PRINTING CYLINDERS OR THE LIKE WITH ADJUSTABLE SIDE REGISTER

The invention relates to a mounting for printing cylinders or the like with an adjustable side register, wherein the cylinder having internal cones at the ends is clamped between complementary external cones of a shaft which is mounted in the machine frame and is mounted against axial displacement in a sleeve which has a screwthread and is axially displaceable by means of a screw connection to a sleeve which is axially undisplaceable with respect to the frame.

In a mounting of this kind known from DE-PS 897 107, the cylinder is mounted on a throughgoing shaft to which an external cone is fixed, whereas the other external cone is arranged on a sleeve which can be pushed onto the shaft and, by means of a screw connection, can be urged towards the other external cone for the purpose of clamping the cylinder tight. The shaft is rotatable at one side but mounted against displacement in a sleeve which is provided with a hand wheel and screwed into a sleeve which is axially undisplaceable with respect to the frame. Since the shaft is axially displaceable on the opposite side, the side register can be adjusted by way of the hand wheel by turning the sleeve.

In the known apparatus, not only is it cumbersome to replace the cylinder, because it is for this purpose necessary to dismantle the entire shaft and, after replacing the cylinder, position the new cylinder on the shaft with the clampable sleeve, but adjustment of the side register by turning the hand wheel is possible only after loosening a clamp connection of the sleeves which, after adjustment of the side register, must again be clamped to each other.

It is the problem of the invention to provide a mounting of the aforementioned kind which permits rapid and simple replacement of the cylinder and, particularly after a cylinder replacement, simplifies the necessary adjustment of the side register whilst ensuring a high clamping force for the cylinder.

According to the invention, this problem is solved in that the external cones are disposed at the confronting ends of journals which are mounted in the frame and of which one is mounted against axial displacement in the sleeve which is axially displaceable but non-rotatable with respect to the machine frame, that the sleeve is screw-connected to an axially undisplaceable sleeve which is rotatable in the machine frame and provided with a rotary drive for adjusting the cylinder axially, and that the journals can be clamped towards each other by the piston rods of hydraulic piston-cylinder units of which the cylinder chambers, which have volumes varying in opposite senses when the side register is adjusted, can be interconnected. The mounting according to the invention permits rapid and simple cylinder replacement in that the one journal is simply withdrawn from the internal cone immediately after or during return movement of the piston rod acting thereon and the other journal is returned after withdrawal of the respective piston rod by actuating the rotary drive by the spindle drive formed by the screw-connected sleeves. The cylinder which is thus released can be exchanged for a different cylinder into the internal cones of which the external cones of the journals are re-introduced in the reverse manner.

For adjusting the side register, it is merely necessary to actuate the rotary drive for the outer sleeve so that the desired axial displacement of the cylinder is produced as a result of the spindle drive. This adjustment of the side register can be effected whilst the full clamping force is being exerted by the piston-cylinder units if there is an interconnection of the cylinder chambers of which the volumes vary in opposite senses during axial adjustment. This is because the spindle drive only has to overcome the friction between the relatively movable parts and the resistances offered as a result of compression of the hydraulic fluid between the cylinder chambers. Undisplaceable clamping of the cylinder is achieved in that the cylinder chambers are disconnected from each other or the outer cylinder chambers are connected to the source of pressure medium.

Desirably, the journal opposite to the journal mounted in the sleeve is rotatably connected to the coaxial piston rod of the piston-cylinder unit so that this journal can be withdrawn at the same time as the piston rod is retracted.

The sleeve mounting the journal can be provided with a radial lever of which the end is guided in an axial guide groove fixed with respect to the frame.

In a further embodiment of the invention, the sleeve screw-connected to the sleeve mounting in journal is rotatable by way of a gear motor. The side register will then be simply adjustable merely be actuating the gear motor, for example by means of a push button, whereby a control valve will then simultaneously ensure that the two respective sides of the cylinders of the piston-cylinder units are interconnected in a manner permitting axial displacement.

Desirably, for adjusting the side register the journal mounted in the sleeve is provided with axially spaced markings which indicate the side register and can be scanned by sensors.

In a further embodiment of the invention, provision is made for the sleeve mounting the journal to be screwed either directly or by way of a stud-shaped extension into the base of the sleeve mounted in the frame and for the piston rod of the piston-cylinder unit to be supported on the sleeve or the extension connected thereto.

One example of the invention will now be described in more detail with reference to the drawing, wherein.

Figure 1:
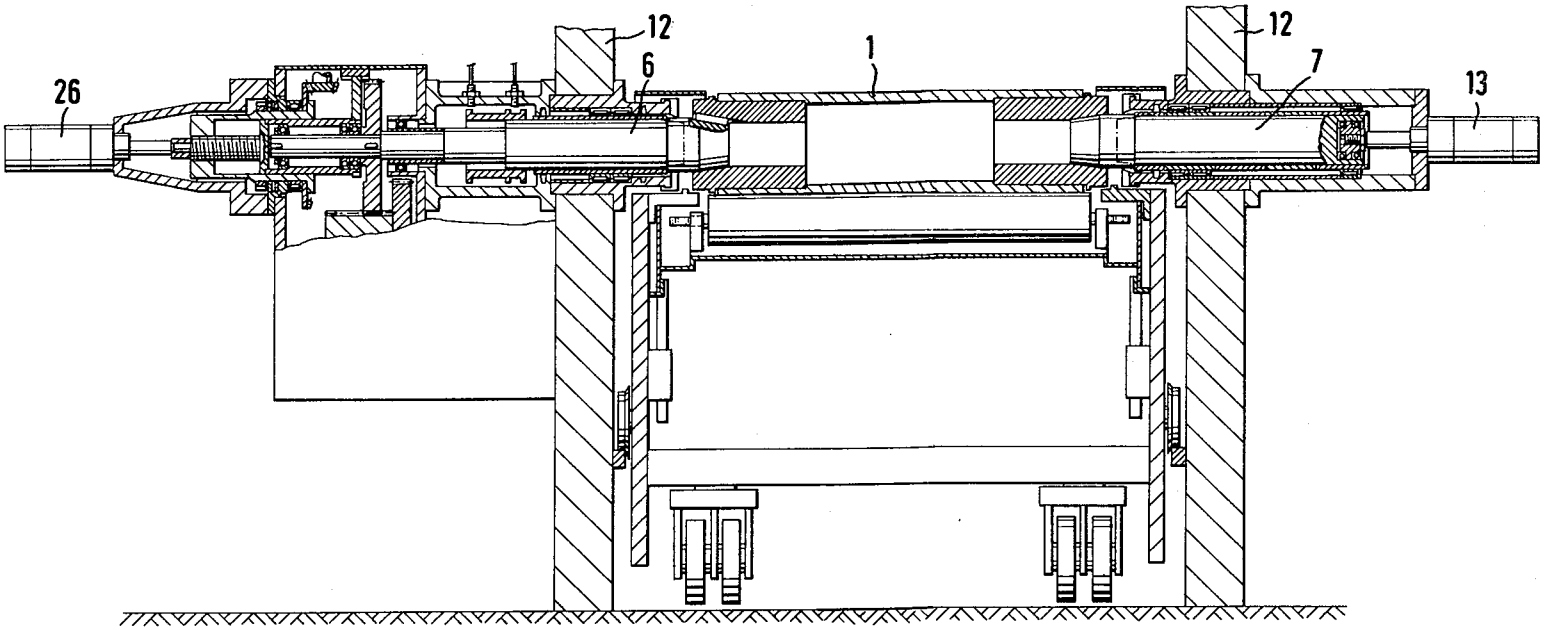
FIG. 1 is a longitudinal section through the mounting of a printing cylinder.
Figure 2:
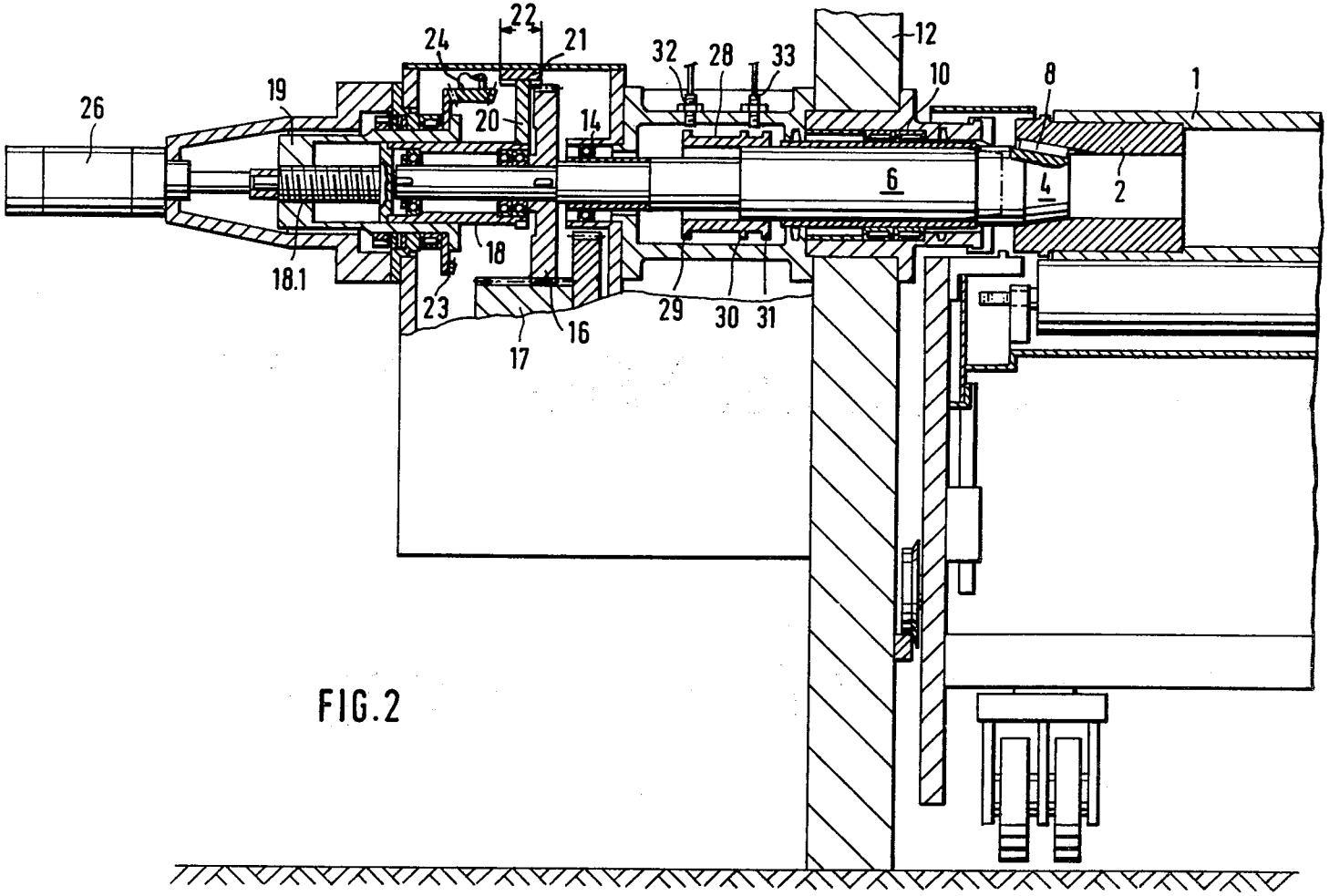
FIG. 2 is an enlargement of the left-hand side of the FIG. 1 mounting.
Figure 3:
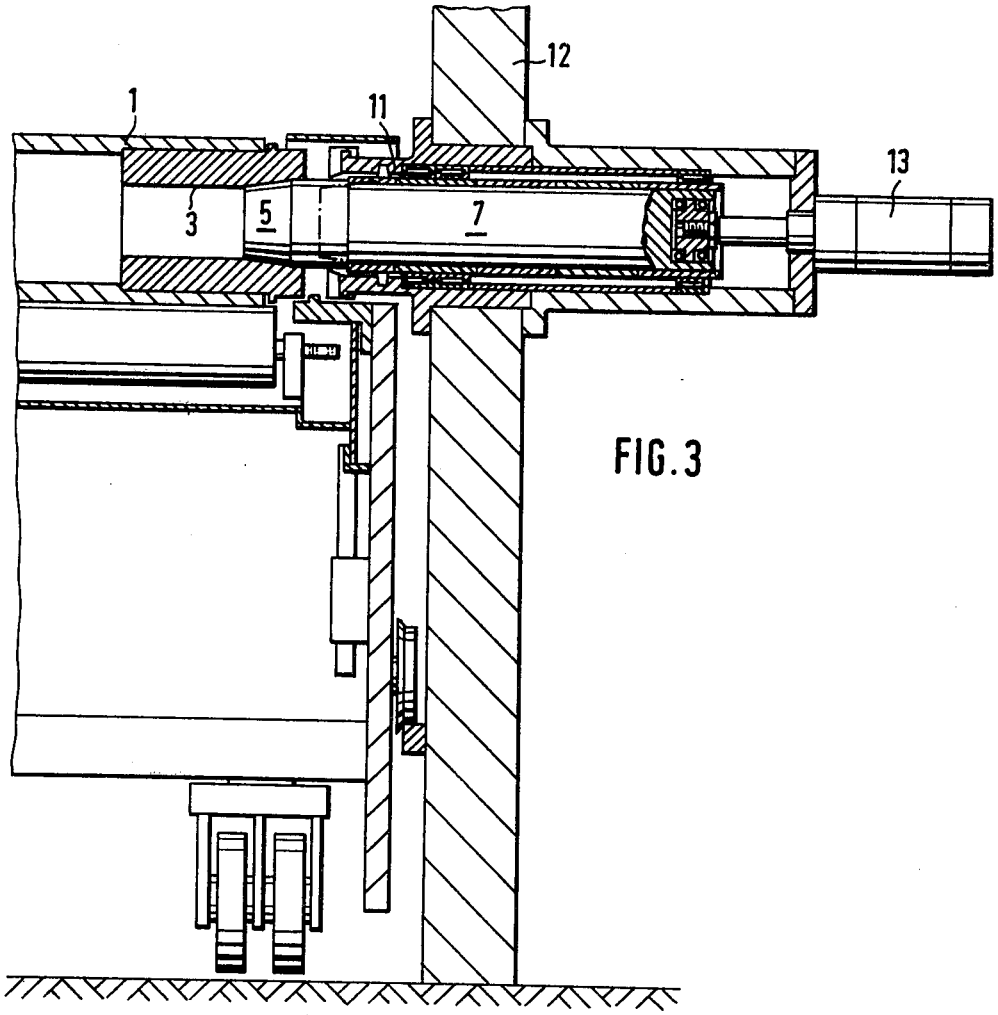
FIG. 3 is an enlargement of the right-hand side of the FIG. 1 mounting.

A cylinder 1, for example a printing cylinder, has at both sides internal cones 2, 3 which are concentric with its medial axis and which engage in the external cones 4, 5 of rotatably mounted journals (centre sleeves) 6, 7 which have a centreing effect and hold the cylinder 1 in the operating position. The external cone 4 is positively connected to the cylinder 1 by means of a key 8 engaging in a slot milled into the internal cone 2. The journals 6, 7 are rotatable in bearing bushes 10, 11 fixed to the frame 12. The bearing bushes 10, 11 are so constructed that the journals 6, 7 are axially displaceable by way of roller bearings for mounting same.

A journal 7 is connected to the piston rod of a fixed hydraulic cylinder 13 so as to be rotatable therewith but axially immovable with respect thereto.

The journal 6 is rotatable in a fixed bearing bush 14 and likewise mounted against axial displacement. A gear 16 keyed to the journal 6 engages a gear 17. The gear 17 is seated on a shaft (not shown) operatively connected to the main drive.

The journal 6 is rotatable but axially immovable in the sleeve 18. The sleeve 18 is axially displaceable in the sleeve 19 surrounding same. Connected to the sleeve 18 there is the radial lever 20 of which the end is guided in the groove of a fixed guide track 21 so that the sleeve 18 cannot turn but merely move axially. The length 22 of the guide track 21 is such that the lever 20 remains engaged with the guide track 21 during its entire axial displacement. The gear 17 is wide enough always to remain engaged with the gear 16. A ring gear 23 fixed to the guide bush 19 engages a bevel gear 24 of which the shaft is fixed with respect to the frame and connected to a gear motor (not shown). The end of the sleeve 18 is connected to a stud 18.1 having a screw-threaded surface engaged in a tapped hole in the base of the guide sleeve 19. By turning the bevel gear 24 and thus the guide sleeve 19, the sleeve 18 is screwed in or out so that the journal 6 connected thereto is pushed to or fro.

By means of the gear motor, the journal 6 can be withdrawn completely from the cylinder 1 or clamped thereagainst. Clamping of the cylinder 1 takes place from the right-hand side by way of the journal 7 by the hydraulic cylinder 13.

In order that the cylinder 13 does not act on the screwthread of the stud 18.1 with full force, a further hydraulic cylinder 26 is provided of which the piston rod is supported on the end face of the stud 18.1.

Figure 4:
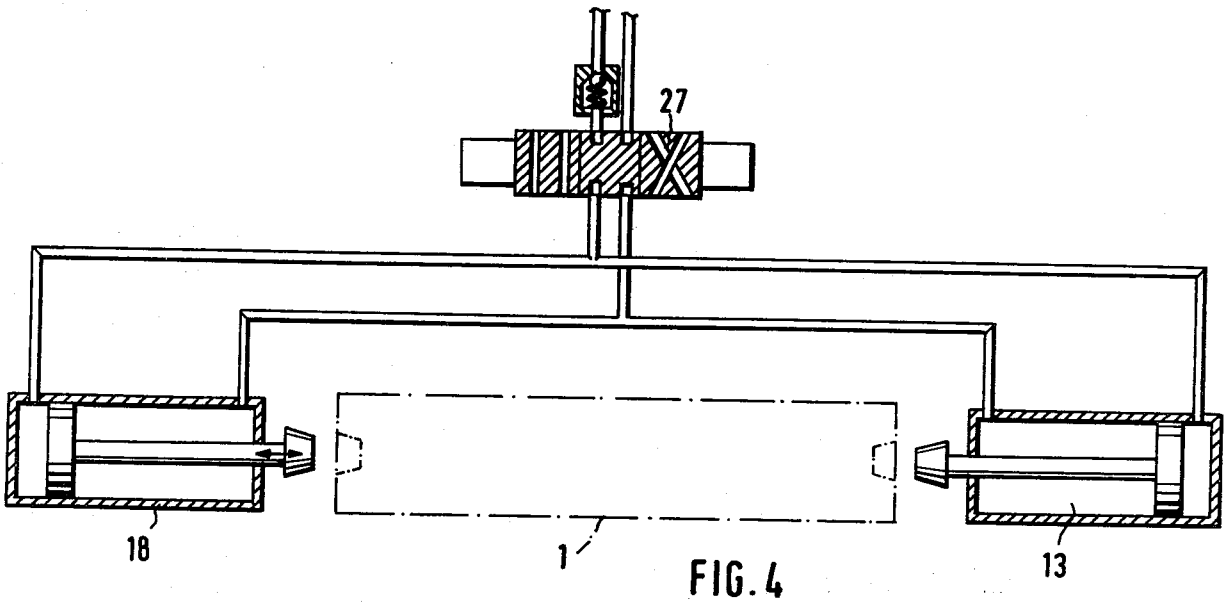
FIG. 4 shows the hydraulic circuit of the mounting.

FIG. 4 diagrammatically illustrates the hydraulic circuit for the two hydraulic cylinders 13, 26 which can be moved towards and away from each other in unison by a four-way valve 27 and separated from the source of pressure medium.

By means of the illustrated connection of the cylinder chambers, the screwthread on the stud 18.1 or in the sleeve 19 is completely relieved and the energy to be applied by the gear motor by way of the bevel gear 24 is limited merely to overcoming the friction in the guides and the resistance as a result of compression of the hydraulic fluid.

To take the cylinder 1 out, the hydraulic cylinders 13, 26 are actuated and the piston rods are retracted, whereby the journal 7 is displaced to the right. The journal 6 is displaced to the left by turning the bevel gear 24 until the cylinder is released.

Secured to the journal 6 there is a sleeve 28 having three projecting switching rings 29, 30, 31 which can be scanned by sensors (initiators) 32, 33. The latter serve to ensure that the correct side register position of the cylinder is achieved. The central position is notified by the initiator 32 when the journal 6 is displaced to the right. The maximum permissible displacements to the right and left are notified by the initiator 33 when the switching rings 30 and 31, respectively, come into its operating range.

We claim:

1. A mounting for printing cylinders or the like with an adjustable side register, wherein the cylinder having internal cones at the ends is clamped between complementary external cones of a shaft which is mounted in the machine frame and is mounted against axial displacement in a sleeve that has a screwthread and is axially displaceable by means of a screw connection to a sleeve which is axially undisplaceable with respect to the frame, characterised in that the external cones are disposed at the confronting ends of journals which are mounted in the frame and of which one is mounted against axial displacement in the sleeve which is axially displaceable but non-rotatable with respect to the machine frame, that the sleeve is screw-connected to an axially undisplaceable sleeve which is rotatable in the machine frame and provided with a rotary drive for adjusting the cylinder axially, and that the journals can be clamped towards each other by the piston rods of hydraulic piston-cylinder units of which the cylinder chambers, which have volumes varying in opposite senses when the side register is adjusted, can be interconnected.

2. A mounting according to claim 1, characterised in that the journal opposite to the journal mounted in the sleeve is rotatably connected to the coaxial piston rod of the piston-cylinder unit.

3. A mounting according to claim 1 or claim 2, characterised in that the sleeve mounting the journal is provided with a radial lever guided in an axial guide groove fixed with respect to the frame.

4. A mounting according to claim 3, characterised in that the sleeve screw-connected to the sleeve mounting the journal is rotatable by way of a gear motor.

5. A mounting according to claim 4, characterised in that the journal mounted in the sleeve is provided with axially spaced markings which indicate the side register and can be scanned by sensors.

6. A mounting according to claim 5, characterised in that the sleeve mounting the journal is screwed either directly or by way of a stud-shaped extension into the base of the sleeve mounted in the frame and that piston rod of the piston-cylinder unit is supported on the sleeve or the stud connected thereto.

7. A mounting according to claim 3, characterized in that the journal mounted in the sleeve is provided with axially spaced markings which indicate the side register and can be scanned by sensors.

8. A mounting according to claim 3, characterized in that the sleeve mounting the journal is screwed either directly or by way of a stud-shape extension into the base of the sleeve mounted in the frame and that the piston rod of the piston-cylinder unit is supported on the sleeve or the stud connected thereto.

9. A mounting according to claim 4, characterzed in that the sleeve mounting the journal is screwed either directly or by way of a stud-shaped extension into the base of the sleeve mounted in the frame and that the piston rod of the piston-cylinder unit is supported on the sleeve or the stud connected thereto.

* * * * *